US007612642B2

(12) United States Patent
Hsu et al.

(10) Patent No.: US 7,612,642 B2
(45) Date of Patent: Nov. 3, 2009

(54) WINDING STRUCTURE OF A TRANSFORMER

(75) Inventors: Cheng-Chia Hsu, Hsinchu County (TW); Yung-Chin Chou, Hsinchu County (TW); Teng-Kang Chang, Hsinchu County (TW)

(73) Assignee: Logah Technology Corp., Hsinchu County (TW)

( * ) Notice: Subject to any disclaimer, the term of this patent is extended or adjusted under 35 U.S.C. 154(b) by 0 days.

(21) Appl. No.: 12/180,409

(22) Filed: Jul. 25, 2008

(65) Prior Publication Data

US 2009/0066455 A1 Mar. 12, 2009

Related U.S. Application Data

(62) Division of application No. 11/852,669, filed on Sep. 10, 2007, now Pat. No. 7,538,651.

(51) Int. Cl.
*H01F 27/30* (2006.01)

(52) U.S. Cl. ..... 336/198

(58) Field of Classification Search ..... 336/65, 336/192, 198, 200, 206–208, 220–223
See application file for complete search history.

(56) References Cited

U.S. PATENT DOCUMENTS 6,201,463 B1 * 3/2001 Yamashita et al. ..... 336/198

* cited by examiner

*Primary Examiner*—Tuyen Nguyen
(74) *Attorney, Agent, or Firm*—WPAT, P.C.; Anthony King; Kay Yang

(57) ABSTRACT

An improved winding structure of a transformer, wherein the transformer comprises a winding base externally set with an isolating plate, the transformer is divided into a primary side region and a secondary side region by the isolating plate. The primary side region has a winding reel for a pre-formed wire set to sleeve on while the secondary side region is divided into a plurality of winding grooves by a plurality of partitions for placing a wire in the grooves, and an iron core set is set on the outside of the winding base and the hollow structure, which altogether form an transformer. In the present invention, an pre-formed wire set is sleeved on a primary side winding reel, therefore, the costs of traditional hand-winding will be displaced, and the manufacturing quality and usage stability of transformers will be effectively improved as well.

2 Claims, 7 Drawing Sheets

WINDING STRUCTURE OF A TRANSFORMER

CROSS-REFERENCE TO RELATED APPLICATIONS

This application claims priority to, and is a Divisional of, U.S. patent Ser. No. 11/852,669, filed on Sep. 10, 2007, now pending which is hereby incorporated by reference in its entirety. Although incorporated by reference in its entirety, no arguments or disclaimers made in the parent application apply to this divisional application. Any disclaimer that may have occurred during the prosecution of the above-referenced application(s) is hereby expressly rescinded. Consequently, the Patent Office is asked to review the new set of claims in view of all of the prior art of record and any search that the Office deems appropriate.

BACKGROUND OF THE INVENTION

1. Field of the Invention

The present invention relates to an improved winding structure of a transformer. More particularly, the present invention relates to a kind of design of winding structure in which a pre-formed wire set can be sleeved on a winding reel, as a result, the costs of hand-winding can be saved, and the quality of transformers can be effectively improved.

2. Descriptions of the Related Art

Referring to FIG. 1, which is a top-view diagram of a conventional transformer, the conventional transformer 1 is formed by a winding base 11, an iron core 12, a wire 13 and a wire 14. The winding base 11 is externally set with a first isolating plate 111, a second isolating plate 112, and a third isolating plate 113, and is divided into a primary side region 15 and a secondary side region 16 by the first isolating plate 111, the second isolating plate 112, and the third isolating plate 113, wherein the primary side region 15 has a winding groove 151, and the secondary side region 16 is divided into a plurality of winding grooves 161 by the partitions 114. Since the wire 13 used in the primary side winding groove 151 is thicker, the wire 13 is wound in the winding groove by hand, while the wire 14 is wound by a machine for its thinness in the secondary side winding groove 161. The iron core 12 can be placed in the hollow structure of the winding base 11, therefore forms a transformer further. However, the foregoing conventional transformer proposes hand-winding, which increases the manufacturing costs of the products. Moreover, the manufacturing quality also varies with different workers, which result in the instability of the products.

The above provides that the aforementioned prior art is still faulty in many aspects, which remains to be improved.

In view of the failings derived from the aforementioned prior art, the inventor of the present invention was inclined to improve upon it, and finally succeeded in developing the present improved winding structure of a transformer after many years of research and development.

SUMMARY OF THE INVENTION

The primary objective of the present invention is to provide a kind of winding structure for a transformer, wherein a pre-formed wire set is sleeved on a primary side winding reel to displace the costs of traditional hand-winding, and the manufacturing quality and using stability of transformers will also be effectively improved.

Another objective of the present invention is to provide a kind of winding structure of a transformer applicable for different types of high voltage transformers.

Yet a further objective of the present invention is to provide a kind of winding structure of a transformer, which has the advantages in lowering manufacturing costs of the products, enhancing stability of the products, extending the life of the products, miniaturizing the size of transformers, and saving setting space.

The improved winding structure of a transformer that can reach the aforementioned objectives is the one which comprises a winding base externally set with an isolating plate, wherein the transformer is divided into a primary side region and a secondary side region by the isolating plate. The primary side region has a winding reel for a pre-formed wire set to sleeve on while the secondary side region is divided into a plurality of winding grooves by a plurality of partitions for placing wire in the grooves, and an iron core set is set on the outside of the winding base and the hollow structure, which altogether form an transformer.

DESCRIPTION OF THE PREFERRED EMBODIMENT

Figure 1:
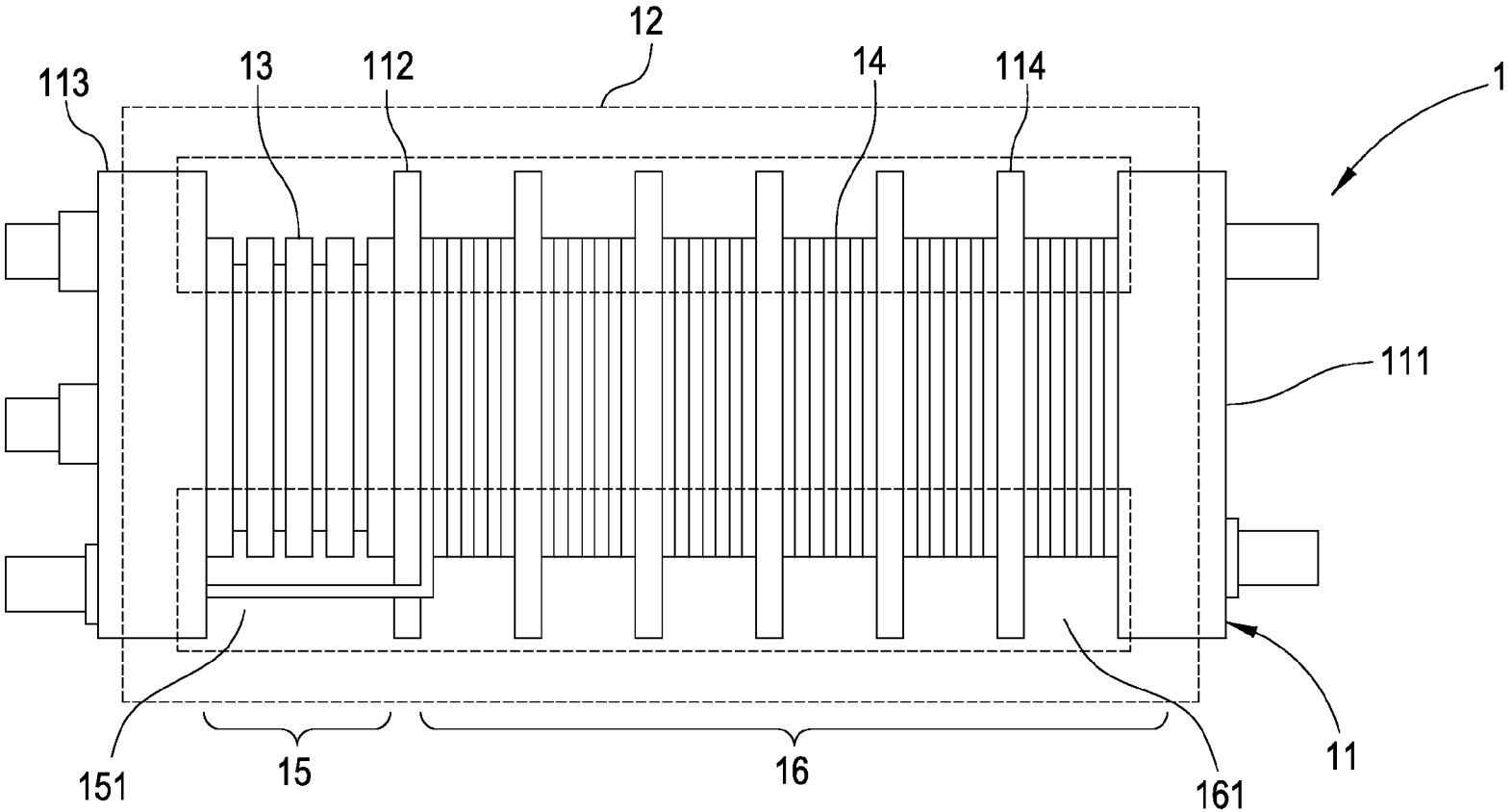
FIG. 1 is a side-view diagram of a conventional transformer.
Figure 2A:
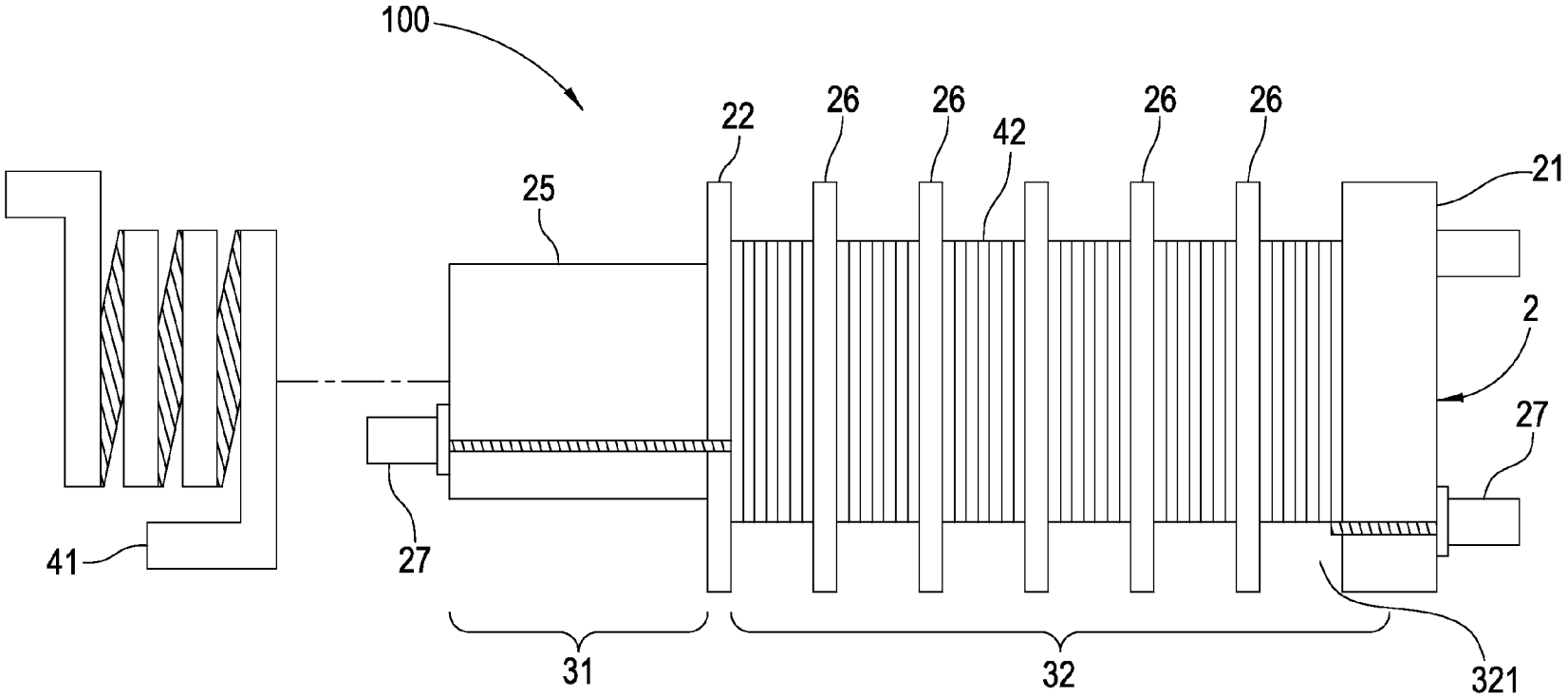
FIG. 2A is a partial explosion diagram and a top-view diagram of a first embodiment of the present improved winding structure of a transformer.
Figure 2B:
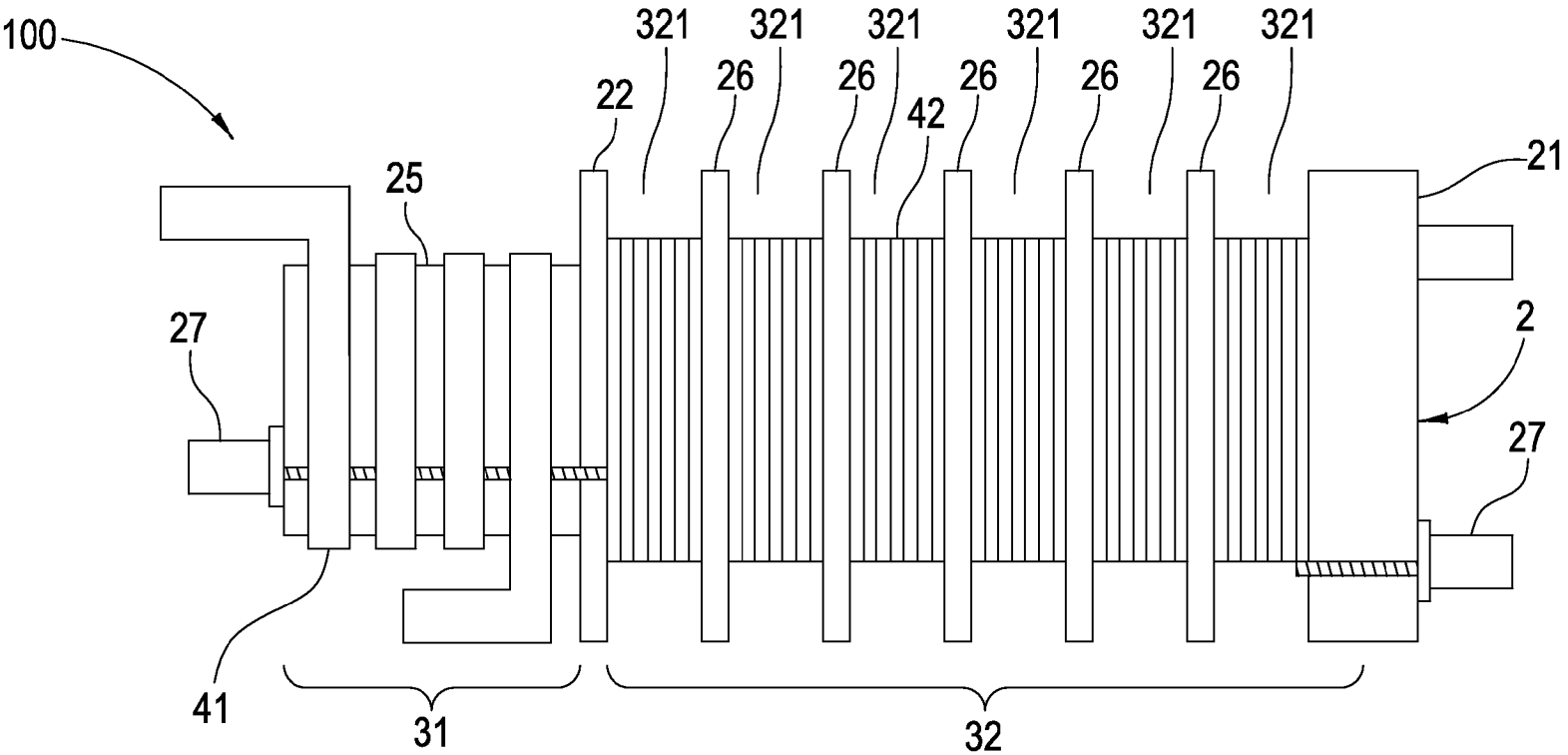
FIG. 2B is a top-view diagram of a first embodiment of the present improved winding structure of a transformer.

Referring to FIG. 2A and FIG. 2B, a partial explosion diagram and a top-view diagram of a first embodiment of the present improved winding structure of a transformer, which shows the present improved winding structure of a transformer comprises a winding base 2 externally set with a first isolating plate 21 and a second isolating plate 22. The transformer is divided into a primary side region 31 and a secondary side region 32 by the first isolating plate 21 and the second isolating plate 22. The primary side region 31 has a winding reel 25 for a pre-formed wire set 41 to sleeve on while the secondary side region 32 is divided into a plurality of winding grooves 321 by partitions 26 for placing wire 42 in the winding grooves 321, wherein the two ends of the wire 42 are respectively affixed on the connectors 27 of the winding reel 25 of the winding base 2 and the connector of the first isolating plate 21 of the winding base; moreover, an iron core set (not shown in the figure) is set on the outside of the winding base 2 and the hollow structure, which altogether form an transformer.

Figure 3:
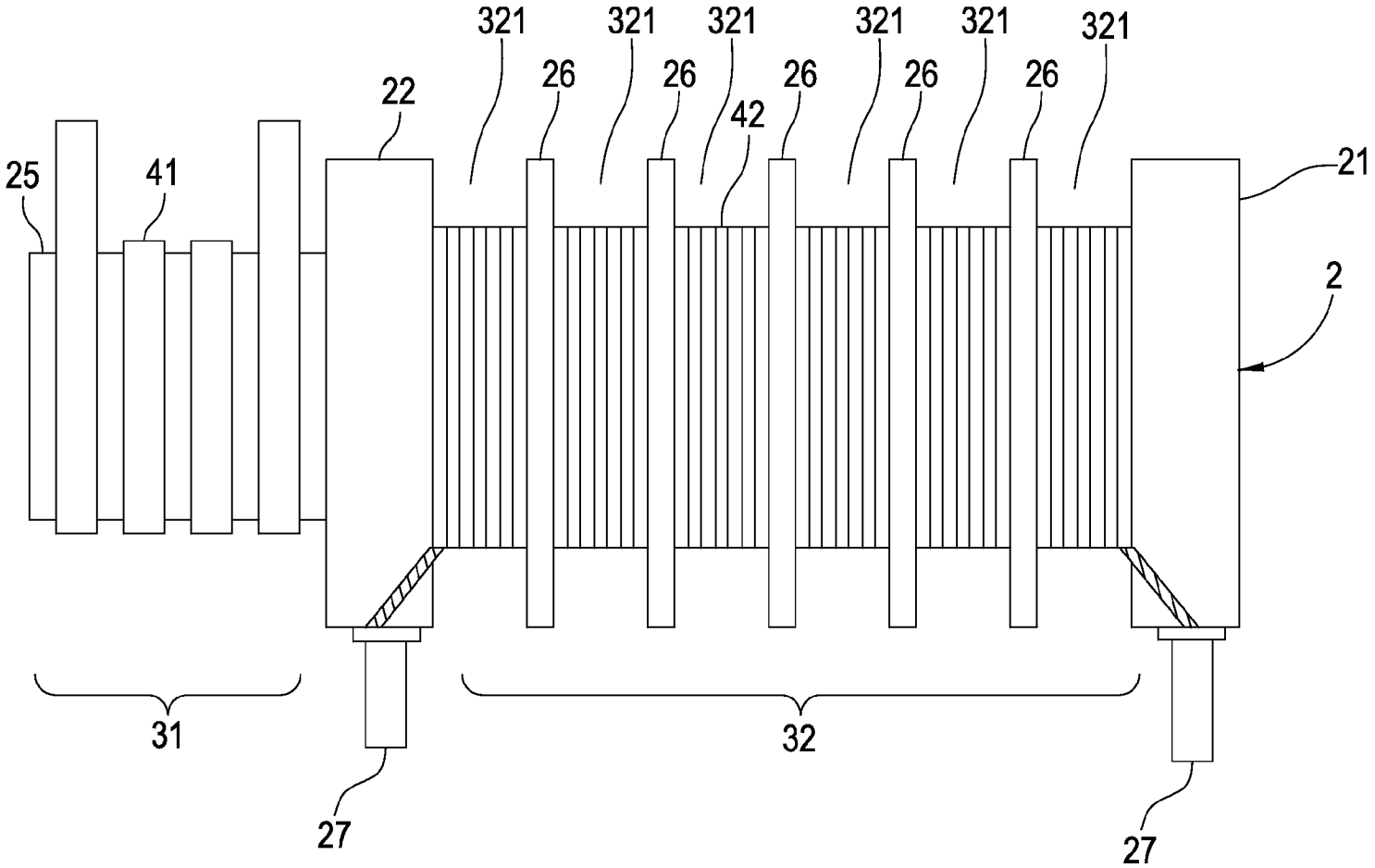
FIG. 3 is a top-view diagram of a second embodiment of the present improved winding structure of a transformer.

Referring to FIG. 3, a top-view diagram of a second embodiment of the present improved winding structure of a transformer, which shows the present improved winding structure comprises a winding base 2 externally set with a first isolating plate 21 and a second isolating plate 22. The transformer is divided into a primary side region 31 and a secondary side region 32 by the second isolating plate 22. The primary side region 31 has a winding reel 25 for a pre-formed wire set 41 to sleeve on while the secondary side region 32 is divided into a plurality of winding grooves 321 by partitions 26 for placing wire 42 in the winding grooves 321, wherein the two ends of the wire 42 are separately affixed on the connector 27 of the first isolating plate 21 of the winding base 2, and the connector 27 of the second isolating plate 22 of the winding base 2; moreover, an iron core set (not shown in the figure) is set on the outside of the winding base 2 and the hollow structure, which altogether form an transformer.

Figure 4:
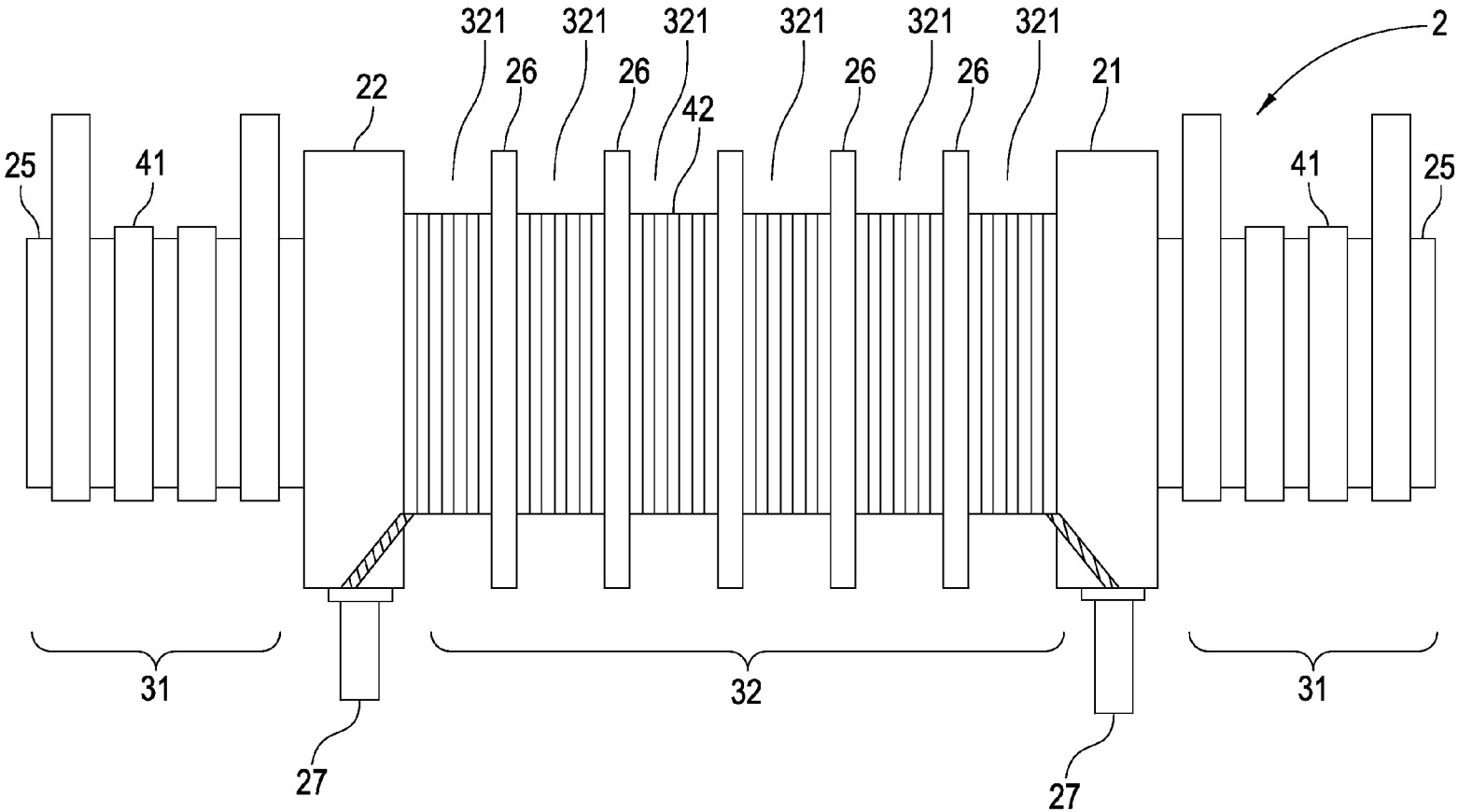
FIG. 4 is a top-view diagram of a third embodiment of the present improved winding structure of a transformer.

Referring to FIG. 4, a top-view diagram of a third embodiment of the present improved winding structure of a transformer, which shows the present improved winding structure comprises a winding base 2 externally set with a first isolating plate 21 and a second isolating plate 22. The transformer is divided into a primary side region 31 and a secondary side region 32 by the second isolating plate 22. Each of the two of the primary side region 31 has a winding reel 25 for a pre-formed wire set 41 to sleeve on while the secondary side region 32 is divided into a plurality of winding grooves 321 by partitions 26 for placing wire 42 in the winding grooves 321, wherein the two ends of the wire 42 are respectively affixed on the connector 27 of the first isolating plate 21 of the winding base 2, and the connector 27 of the second isolating plate 22 of the winding base 2; moreover, an iron core set (not shown in the figure) is set on the outside of the winding base 2 and the hollow structure, which altogether form an transformer.

Figure 5A:
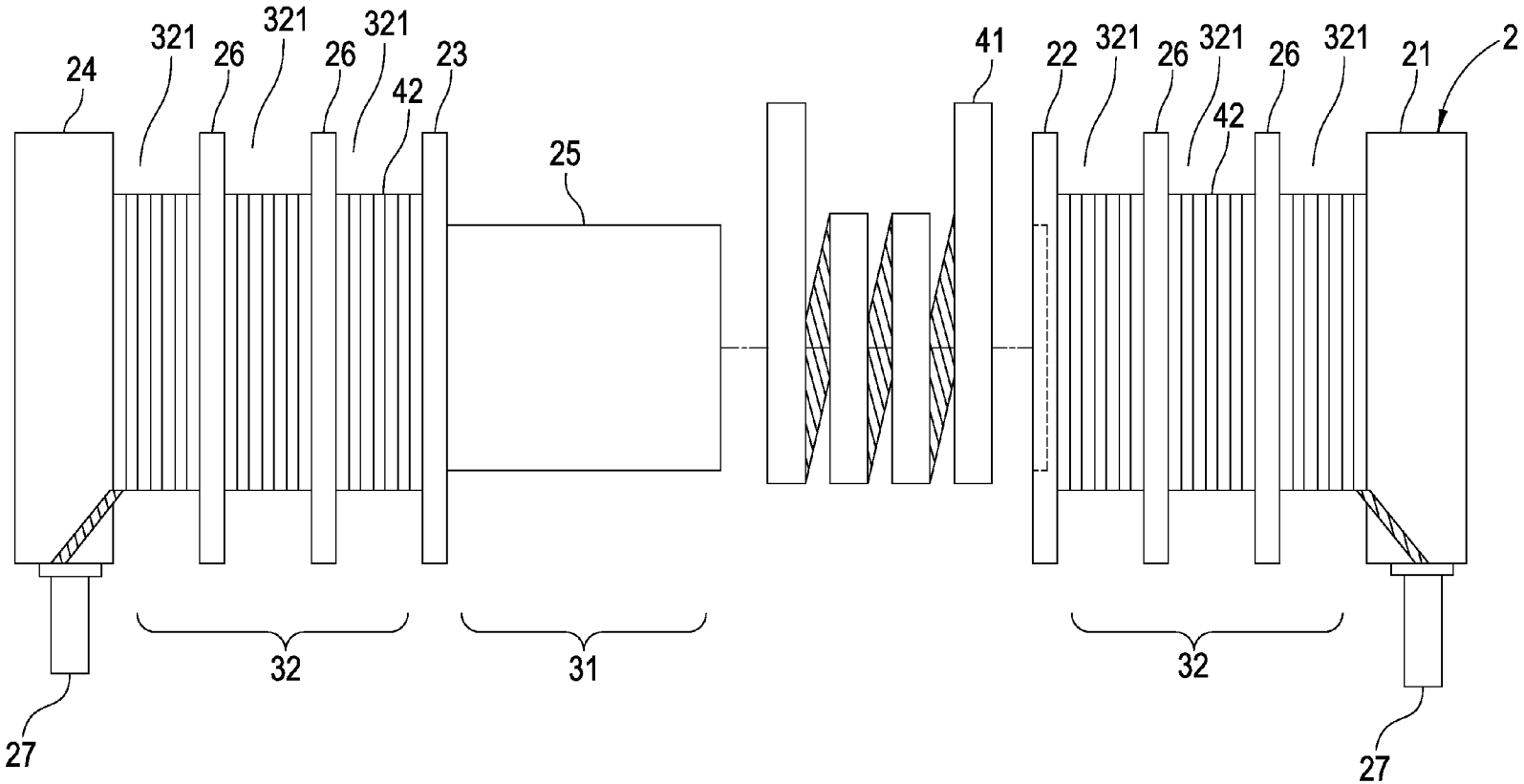
FIG. 5A is a partial decomposition diagram of a fourth embodiment of the present improved winding structure of a transformer.
Figure 5B:
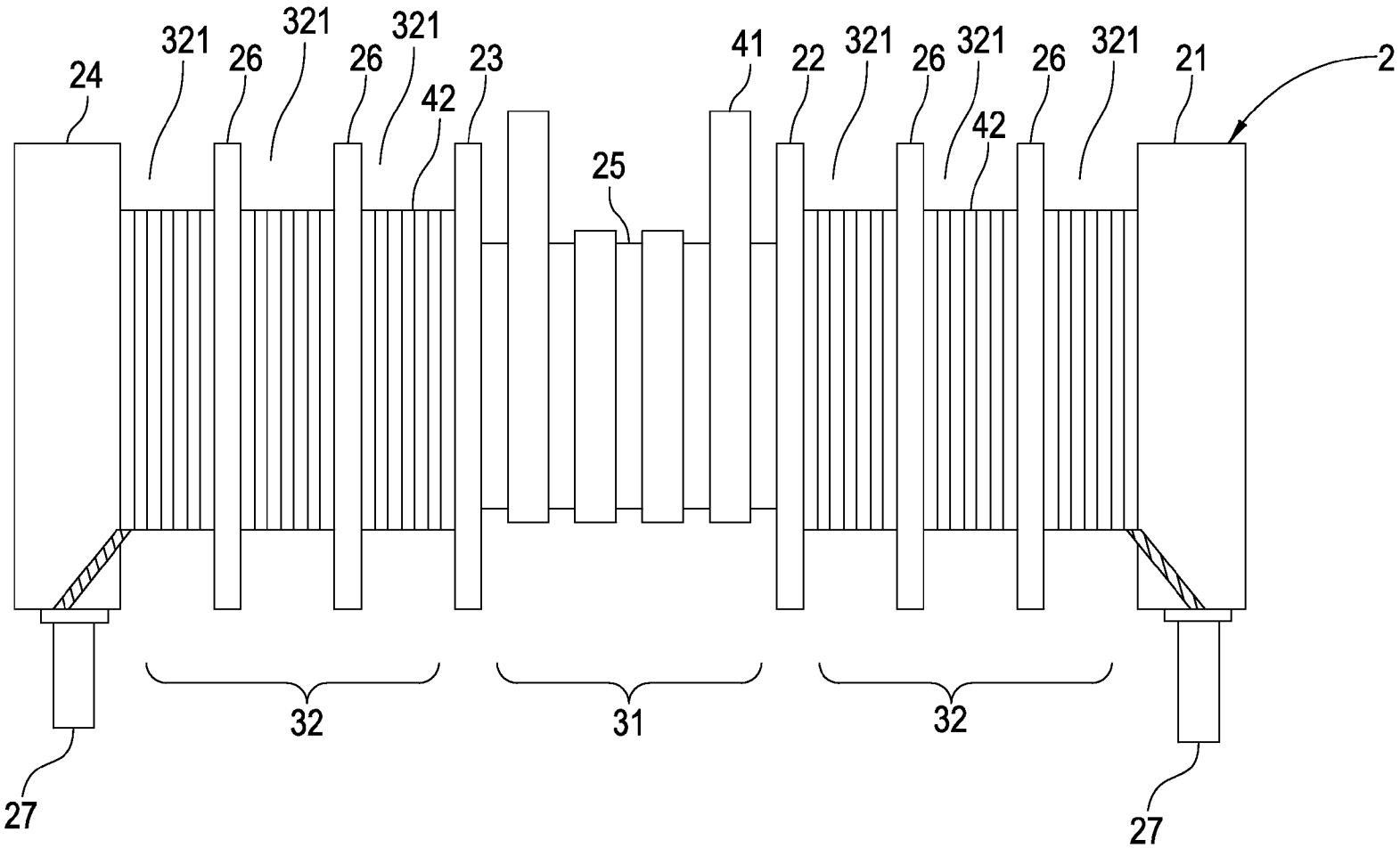
FIG. 5B is a top-view diagram of the present improved winding structure of a transformer.

Referring to FIG. 5A and FIG. 5B, a partial decomposition diagram and a top-view diagram of a fourth embodiment of the present improved winding structure of a transformer, which shows that the winding base is divided into two portions, and the pre-formed wire set is configured to combine with the two portions. Wherein the winding base 2 comprises a first isolating plate 21, a second isolating plate 22, a third isolating plate 23, and a fourth isolating plate 24, the transformer is divided into a primary side region 31 and two secondary side regions 32 by the first isolating plate, the second isolating plate, the third isolating plate, and the fourth isolating plate, in which the primary side region 31 has a winding reel 25 for a pre-formed wire set 41 to sleeve on, and each of the two secondary side regions 32 is divided into a plurality of winding grooves 321 by a plurality of partitions 26 for placing a wire 42 in the grooves with two ends of the wire affixed on connectors respectively, wherein the two ends of the wire 42 are separately affixed on the connector 27 of the first isolating plate 21 of the winding base 2, and the connectors 27 of the fourth isolating plate 24 of the winding base 2; moreover, an iron core set (not shown in the figure) is set on the outside of the winding base 2 and the hollow structure, which altogether form an transformer.

Comparing with other prior art, the present improved winding structure of a transformer has the advantages as follows:

1. the present improved winding structure of a transformer employs a pre-formed wire set sleeved on a winding reel that can save the costs of hand-winding and improve the manufacturing quality and usage stability of transformers;
2. the present improved winding structure of a transformer is applicable for different types of high voltage transformers; and
3. the present improved winding structure of a transformer has advantages in lowering the manufacturing costs of the products, enhancing usage stability of the products, extending the life of the products, miniaturizing the size of transformers, and saving occupying space.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

As aforementioned, the present invention is novel in technology and advantaged in many effects that the prior arts lack.

What is claimed is:

1. An improved winding structure of a transformer, wherein the transformer comprises a winding base externally set with a first isolating plate and a second isolating plate, the transformer is divided into a primary side region and a secondary side region by the first isolating plate and the second isolating plate, wherein no groove is disposed between the primary side region and the secondary side region and the groove is a space without winding, in which the secondary side region is divided into a plurality of winding grooves by a plurality of partitions for placing a wire in the grooves with two ends of the wire affixed on connectors respectively, a pre-formed wire set is coupled to the primary side region, in which the primary side region has a winding reel to sleeve on the pre-formed wire set.

2. The improved winding structure as claimed in claim 1, wherein the two ends of the wire are separately affixed on the connectors of the first isolating plate of the winding base, and the connector of the second isolating plate of the winding base.

* * * * *